US010365077B2

(12) United States Patent
Borgstöm et al.

(10) Patent No.: US 10,365,077 B2
(45) Date of Patent: Jul. 30, 2019

(54) DETONATOR PROVIDED WITH A SECUREMENT DEVICE

(71) Applicant: LIFE TIME ENGINEERING AB, Stockholm (SE)

(72) Inventors: Ulf Borgstöm, Trosa (SE); Lars-Erik Pettersson, Karlstad (SE)

(73) Assignee: LIFE TIME ENGINEERING AB, Stockholm (SE)

( * ) Notice: Subject to any disclaimer, the term of this patent is extended or adjusted under 35 U.S.C. 154(b) by 0 days.

(21) Appl. No.: 15/764,114

(22) PCT Filed: Oct. 5, 2016

(86) PCT No.: PCT/SE2016/050950
§ 371 (c)(1),
(2) Date: Mar. 28, 2018

(87) PCT Pub. No.: WO2017/061935
PCT Pub. Date: Apr. 13, 2017

(65) Prior Publication Data

US 2018/0274893 A1 Sep. 27, 2018

(30) Foreign Application Priority Data

Oct. 5, 2015 (SE) ..... 1551275

(51) Int. Cl.
*F42C 15/00* (2006.01)
*F42C 15/34* (2006.01)

(52) U.S. Cl.
CPC ..... *F42C 15/34* (2013.01); *F42C 15/00* (2013.01)

(58) Field of Classification Search
CPC ..... F42C 15/00; F42C 15/18; F42C 15/184; F42C 15/34; F42C 19/00; F42C 19/02; F42C 19/04

(Continued)

(56) References Cited

U.S. PATENT DOCUMENTS 3,577,926 A 5/1971 Schuemann
4,090,450 A * 5/1978 Nygards ..... F42C 15/34 102/244

(Continued)

FOREIGN PATENT DOCUMENTS

DE 2900067 7/1980
DE 2900067 A1 * 7/1980 ..... F42B 3/16

(Continued)

OTHER PUBLICATIONS

International Search Report issued in PCT/SE2016/050950 dated Dec. 16, 2016, pp. 1-4.

(Continued)

*Primary Examiner* — James S Bergin
(74) *Attorney, Agent, or Firm* — Jeffrey S. Melcher; Melcher Patent Law PLLC

(57) ABSTRACT

A detonator arrangement (10) comprising a detonator (1) having an initiation charge (2) and a base charge (3), which initiation charge (2) is arranged to initiate a detonation of said base charge (3), characterized in that the said detonator arrangement (10) comprises a securement device (5, 72, 64) movable in relation to the detonator (1), which securement device (5, 72, 64) can be disposed in a first position arranged to prevent a transfer of the detonation of the initiation charge (2) to the base charge (3), whereby the detonation of the base charge is avoided, and in a second position arranged to allow the transfer of the detonation of the initiation charge (2) to the base charge (3), whereby the detonation of the base charge is obtained.

13 Claims, 2 Drawing Sheets

(58) Field of Classification Search
USPC ..... 102/222, 254, 275.11
See application file for complete search history.

(56) References Cited

U.S. PATENT DOCUMENTS

| | | | | |
|---|---|---|---|---|
| 6,736,068 | B1 * | 5/2004 | Dumenko | C06C 7/00 102/202.5 |
| 7,055,437 | B1 * | 6/2006 | Robinson | F42C 15/184 102/222 |
| 7,343,860 | B2 * | 3/2008 | Michel | F42C 1/04 102/216 |
| 7,712,419 | B1 | 5/2010 | Cheng | |
| 8,161,880 | B2 * | 4/2012 | Wuensche | F42B 3/10 102/275.1 |
| 2013/0008334 | A1 * | 1/2013 | Claridge | C06B 21/0033 102/202.5 |
| 2013/0206027 | A1 * | 8/2013 | Bengtsson | F42B 3/02 102/322 |

FOREIGN PATENT DOCUMENTS

| | | | | |
|---|---|---|---|---|
| GB | 2119485 | | 11/1983 | |
| GB | 2119485 | A * | 11/1983 | F42C 15/31 |
| SE | 534577 | | 8/2011 | |
| SE | 1500290 | | 6/2015 | |
| WO | WO-2011096872 | A1 * | 8/2011 | F42B 3/02 |

OTHER PUBLICATIONS

Written Opinion issued in PCT/SE2016/050950 dated Dec. 16, 2016, pp. 1-5.

* cited by examiner

DETONATOR PROVIDED WITH A SECUREMENT DEVICE

TECHNICAL FIELD

The present invention relates to a detonator arrangement comprising a detonator having an initiation charge and a base charge, which initiation charge is arranged to initiate a detonation of said base charge.

BACKGROUND ART

A detonator arranged to be secured against unintentional firing is described in DE2900067. The detonator described therein comprises a safety distance between a primary charge and a main charge, at which initiation of the main charge cannot occur. A delay body containing a delay charge and the primary charge is situated on a support element on one side of the safety distance, opposite to the main charge. Upon initiation of the intended ignition, a gas pulse is generated, which forces the delay body to pierce the support element while traveling through the safety distance to the main charge. At the same time the burning of the delay charge is initiated by the ignition input. The primary charge, ignited by the delay charge, can now in its turn ignite the main charge as the safety distance between these charges was eliminated at ignition.

Although some security degree is reached, once the ignition of the delay charge is achieved, the chain of processes described above will unroll and the detonator of DE2900067 will fire.

SUMMARY OF THE INVENTION

The object of present invention is to provide a detonator arrangement with an improved safety degree in handling and transportation as well as during storage.

The detonator arrangement of the present invention comprises a detonator having an initiation charge and a base charge. The initiation charge is arranged to initiate the detonation of the base charge. The object of the invention is achieved through the fact that the detonator arrangement also comprises a securement device, which is movable in relation to the detonator, and which can be disposed in two different positions. The securement device in said first position is arranged to prevent a transfer of the detonation of the initiation charge to the base charge, and in a second position is arranged to allow a transfer of the detonation of the initiation charge to the base charge, whereby detonation of the base charge is obtained.

It is understood that the detonator and the securement device are movable in relation to each other. This means that in some embodiment, the detonator is fixed and the securement device is movable, while in other embodiments the detonator is movable and the securement device is fixed.

Unlike the detonator described by DE2900067, the detonator arrangement of the present invention comprises a securement device which prevents firing of the detonator even if the ignition of the initiation charge is unintentionally reached. This enhanced security level enables dense packaging of the detonator while still fulfilling the requirements for packaging arrangement with the hazard classification 1.4S and 1.4B. As 1.4S and 1.B are hazard classes not requiring special license, the new classification comes with major savings in costs and routines at storage, as well as at transportation and handling.

In one embodiment of the invention, the securement device when in said second position is disposed to ensure a transition from deflagration to detonation of said initiation charge.

Deflagration to detonation transition (DDT) refers to a phenomenon in ignitable mixtures of a flammable gas and air (or oxygen) when a sudden transition takes place from a deflagration type of combustion to a detonation type of combustion. A deflagration is characterized by a subsonic flame propagation velocity, typically far below 100 m/s, and relatively modest overpressures, roughly below 0.5 bar. The main mechanism of combustion propagation is of a flame front that moves forward through the gas mixture. In its most benign form, a deflagration may simply be a flash fire. In contrast, a detonation is characterized by supersonic flame propagation velocities, perhaps up to 2000 m/s, and substantial overpressures, up to 20 bars. The main mechanism of combustion propagation is of a powerful pressure wave that compresses the unburnt gas ahead of the wave to a temperature above the autoignition temperature. Under certain conditions, a subsonic flame may accelerate to supersonic speed, transitioning from deflagration to detonation.

When the securement device is positioned in the first position, it is disposed in such way to allow deflagration of the initiation charge but at the same time not to favor the transition from deflagration to detonation. The ignition of the initiation charge will by this means not be strong enough to initiate the base charge, whereby detonation of the base charge is avoided. Accordingly, an accidental ignition of the initiation charge (when securement device is in secure mode) will not cause the detonation of the base charge and thereby the detonator will remain unfired. Only when the securement device is in said second position is enough pressure accumulation possible to favor DDT. In this case the ignited initiation charge will detonate, which is strong enough to initiate the base charge leading to the detonator being fired.

In another embodiment of the invention, an insulating layer is disposed between the initiation charge and the base charge. The insulating layer may comprise a body, preferably in the form of a metal containing disc, more preferably an aluminum disc. The insulating layer shields the base charge from the combustion energy of the deflagrating initiation charge in case of accidental ignition of the said initiation charge maintaining the detonator unfired. This further contributes to the increased safety degree shown by the detonator arrangement of the present invention.

In another embodiment of the invention, the transition from the secure mode to the activated mode is preferably achieved by moving the securement device, in relation to the detonator, from the first to the second position. The securement device is arranged to be positioned at a distance from at least a part of said initiation charge in said first position and is arranged to surround at least the said part of said initiation charge, in said second position. As the DDT takes place in a part of the initiation charge, situated in the close vicinity of the insulating layer, the positioning of the securement device away from said part ensures a secure mode, as the base charge remains uninitiated as long as the initiation charge undergoes deflagration but not detonation. It is preferred that the securement device has a sleeve-shaped, or more preferably a cylinder-shaped body for surrounding tightly the detonator when in second position.

As an unintentional transition from the secure mode to the activated mode (which can be involved in a drop or other accidents) has quite a low probability, the safety in storage, transport or handling of the detonator arrangement of the present invention is substantially increased.

In another embodiment of the invention, a housing surrounding the initiation charge is arranged to release the combustion energy of the initiation charge in another direction than towards the base charge when the securement device is in secure mode, for instance by allowing penetration of the side walls of the housing. This further contributes to the increased safety degree shown by the detonator arrangement of the present invention. It is preferred that the said housing surrounding the initiation charge shows a resistance to detonation which is lower than the resistance to detonation of said insulating layer, which in its turn is lower than the resistance to detonation of said securement device. In this way, when the securement device is in activated mode, the detonation of the initiation charge will remain inside the walls of the housing strengthen by the securement device while said detonation will rupture the insulating layer reaching the base charge, and consequently firing the detonator. On the other hand, when the securement device is in secure mode, the combustion energy of the initiation charge will penetrate the side walls of the housing however not penetrating the insulating layer, and thereby leaving the base charge unfired. By these means, the secure mode and the activated mode are very well defined and easy to control.

In another embodiment of the invention, said initiation charge comprises a secondary explosive, a pyrotechnical material or a combination thereof. By avoiding the use of a primary explosive, the risk to accidentally ignite the initiation charge is substantially decreased and consequently the safety of the detonator is improved.

In another embodiment of the invention, the securement device can be arranged to be a part of a fuzing system or another complex detonating system. In this way, the detonator is in secure mode during the entire handling time, until placed in the activated mode, with the securement device surrounding the second part of the initiation charge.

BRIEF DESCRIPTION OF THE DRAWINGS

Below embodiments of the invention will be described with reference to the drawings, in which.

DETAILED DESCRIPTION OF THE INVENTION

Figure 1:
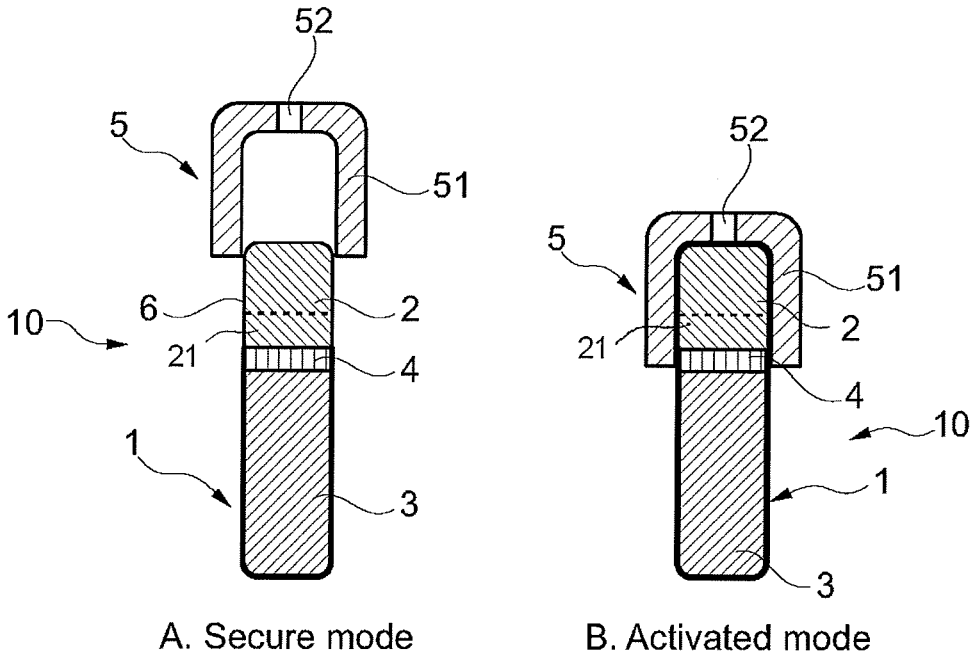
FIG. 1A illustrates schematically a longitudinal, cross-sectional view through the detonator arrangement, when the securement device (here a cap) is situated in a first position (secure mode)
FIG. 1B illustrates schematically a longitudinal, cross-sectional view through the detonator arrangement, when the securement device (here a cap) is situated in a second position (activated mode)
Figure 2:
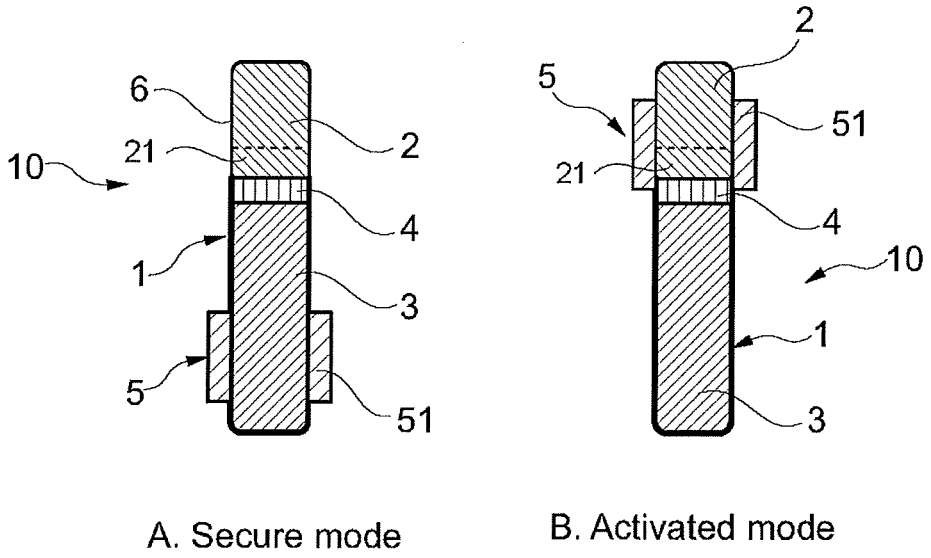
FIG. 2A illustrates schematically a longitudinal, cross-sectional view through the detonator arrangement, when the securement device (here a ring) is situated in another possible first position (secure mode)
FIG. 2B illustrates schematically a longitudinal, cross-sectional view through the detonator arrangement, when the securement device (here a ring) is situated in the second position (activated mode)

FIGS. 1 and 2 illustrate schematically a detonator arrangement 10. The detonator arrangement 10 may comprise a detonator 1 and a securement device 5.

In this embodiment of the invention, the detonator 1 comprises an initiation charge 2 situated in one extremity of the detonator 1, a base charge 3, situated in the other extremity of the detonator 1, opposite to the initiation charge 2, and an insulating layer 4, situated between the initiation charge 2 and the base charge 3.

The initiation charge 2 of the detonator 1, may comprise a secondary explosive material, a pyrotechnic material or a combination thereof.

The base charge 3 may comprise a secondary explosive material.

The insulating layer 4 may comprise a body with adequate resistance to detonation, preferably in the form of a metal containing disc, more preferably an aluminum disc. A housing 6 of the detonator 1 surrounds the initiation charge 2.

The securement device 5 may be a cap (as illustrated in FIG. 1) or a ring (as illustrated in FIG. 2). The securement device 5 may have a sleeve-shaped body 51, preferably a cylinder-shaped body 51. When being a cap (FIG. 1), the securement device 5 may present an opening 52 at one extremity, opposite to the extremity which surrounds the detonator 1, when in second position. Opening 52 enables the ignition of the initiation charge 2. Opening 52 may have the same diameter as the body 51 has, in which case the securement device 5 is a cylinder or a ring (FIG. 2). The securement device 5 is situated in a first position when in secure mode A and in a second position when in activated mode B.

When the securement device 5 is situated in the second position (activated mode FIGS. 1B and 2B), the ignited initiation charge 2 undergoes a deflagration to detonation transition (DDT). The phenomenon is not observed without the securement device in place, and thereby the securement device 5 is (besides a mechanical strengthener for the housing 6) even the key element for ensuring enough pressure accumulation to favor the DDT to take place. The dimensions and material properties of the insulating layer 4 are of relevance as well. A material with too high resistance to detonation will not break down during the detonation of initiation charge 2, while a low resistant material will rupture too early preventing the pressure accumulation, which in its turn enables the DDT. At the same time it is important that the securement device 5 has a higher resistance to detonation than the insulating layer 4, making possible to direct the detonation of the initiation charge through the insulating layer 4 all the way to the base charge 3, while itself remaining unaffected. When the securement device 5 is situated in the second position, the said securement device 5 surrounds at least a part 21 of the initiation charge 2, where this undergoes DDT; although it may extend all the way to surrounding the entire initiation charge 2 at one end and surrounding the insulating layer 4 at the other end.

An ignition of the initiation charge 2 in the activated mode B leads to the DDT in the said part 21 of the initiation charge 2 bordering the insulating layer 4. The chock wave from the detonation of the initiation charge 2 will rupture the insulating layer 4 which thereby releases the detonation force towards the base charge 3. At the same time, the wall of the housing 6 strengthened by the securement device 5 will show a higher resistance to detonation than the insulating layer 4, and will repel the detonation. Consequently, when the securement device 5 is situated in the second position, the detonation of the initiation charge 2 is directed towards the base charge 3, whereby detonation of the base charge 3 is obtained, and thus the detonator 1 is fired.

When the securement device 5 is situated in a first position (secure mode—FIG. 1A, 2A), the said securement device 5 is situated at a distance from the said part 21 of the initiation charge 2 where this undergoes DDT. This said first position can be situated close to one end of the detonator 1 (FIG. 1A), besides the detonator (not illustrated) or even along the detonator 1 (FIG. 1B), however at a distance from the said part 21 of the initiation charge 2.

If in this secure mode A, an ignition of the initiation charge 2 is unintentionally reached, the deflagration of initiation charge 2 will take place (while no DDT is achieved), which will not rupture the insulating layer 4 and will therefore not ignite the base charge 3. Moreover, the housing 6 of the detonator 1 is designed in such a way to show a lower resistance to detonation than the insulating layer 4. Thereby, at the deflagration of the initiation charge 2, the combustion energy will be released in another direction than towards the base charge 3, for instance by allowing penetration of the side walls of the housing 6. Therefore, the base charge 3 will not be initiated and the detonator 1 will remain unfired.

The transition from the secure mode A to the activated mode B is achieved by moving the securement device 5 from the first to the second position. As the securement device 5 is arranged to be placed in the second position under human or automated control, the transition is not reached by uncontrolled mechanical forces (which can be involved in a drop or other accidents) and thereby the safety in storage, transport or handling of the detonator arrangement 10 is substantially increased.

Figure 3:
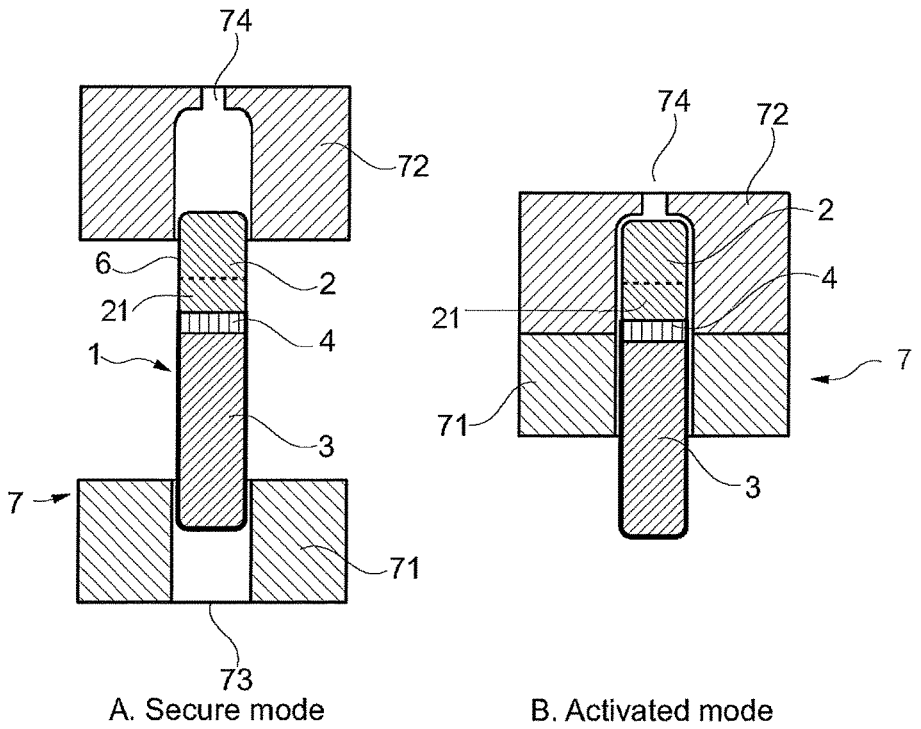
FIG. 3A illustrates a longitudinal, cross-sectional view through the detonator arrangement, when the securement device is part of a fuzing system and the securement device is situated in the first position (secure mode)
FIG. 3B illustrates a longitudinal, cross-sectional view through the detonator arrangement, when the securement device is part of a fuzing system and the securement device is situated in the second position (activated mode)

In still another embodiment of the invention, the securement device can consist of at least one block 72 and can be part of a fuzing system 7 (FIG. 3). A fuzing system has often environmental conditions that have to be fulfilled before the fuzing system can initiate the base charge. The securement device 72 can thus be designed so that it only can be moved into the activated mode B after the environmental conditions have been fulfilled. Environmental conditions can be: acceleration, pressure, electrical power, etc.

The securement device 72 can have an attachable part 71. In such case, the detonator 1 may be situated between a first block 71 and a second block 72. Both blocks may have an opening at the outer extremities. The first block 71 may have an opening 73 opposite to the extremity surrounding the part of detonator 1 comprising the base charge 3. Opening 73 enables the transfer of the detonation of the base charge 3 to a main charge or a booster. The second block 72, may have an opening 74 (equivalent to opening 52 in FIG. 1), opposite to the extremity surrounding said part 21 of the initiation charge 2, when in second position B. Opening 74 enables the ignition of initiation charge 2. Opening 74 may have the same diameter as the cavity hosting the detonator 1, in which case the second block 72 will resemble a ring and not a cap.

In still another embodiment of the invention, the first block 71 may be fixed or movable in relationship to the detonator 1, while the second block 72, is movable in relationship to the detonator 1. To reach activated mode (FIG. 3B) and direct the detonation of the base charge 3 towards a main charge or a booster situated in close vicinity to the first block 71, away from opening 73, the two blocks 71 and 72, consisting the securement device, have to come in contact with each other. When both blocks are movable independent of each other (while detonator 1 is fixed by additional means), there are three independent parts of the arrangement (i.e. the lower block 71, the upper block 72, and the detonator 1) which have to be situated in a certain way in order to achieve detonation (i.e. in order to reach the activated mode B). In this particular case, probability to unintentionally reach the activated mode B is even lower and thereby the security of handling and storing the detonator arrangement 10 is further increased compared to the assembly described in FIG. 1 or 2, where only two components, namely the securement device 5 and the detonator 1 defined the activated mode B.

Figure 4A:
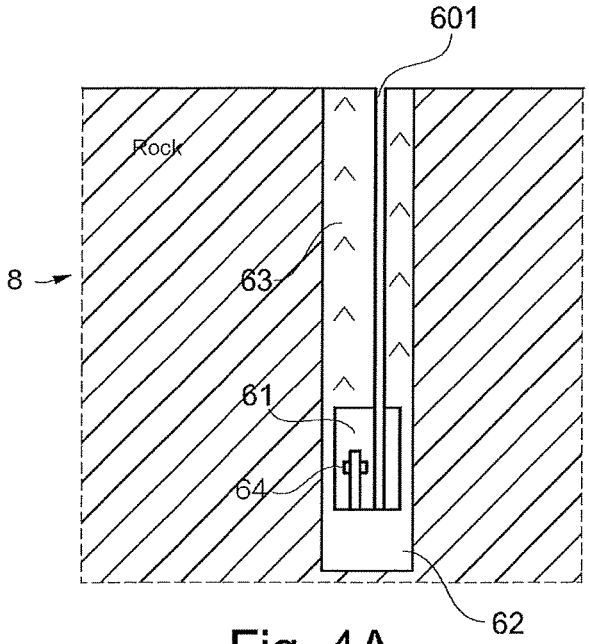
FIG. 4A illustrates schematically an arrangement in a rock drilling system where the securement devise is integrated in the arrangement
Figure 4B:
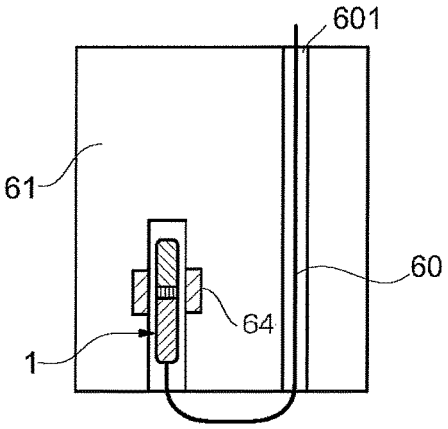
FIG. 4B is a detailed illustration of a booster component of a rock drilling system as presented in FIG. 4A, where the detonator is placed in active mode with respect to the incorporated securement device

In still another embodiment of the invention, the securement device 64 (FIG. 4) can be integrated in a blasting system, as for example as part of a rock drill system. At the bottom of a drill hole 62, in the vicinity of a booster 61, the detonator 1 having a wire 60 can be directed through a cavity 601 and placed in the desired position relative to the integrated securement device 64. Thus, the securement device 64 is movable in relation to the detonator 1. Only when the conditions for the activated mode are fulfilled (FIG. 4B), can the detonator 1 be fired, (and in its tur detonate the booster 61 and consequently the explosive 63). This requirement for precise alignment increases considerably the safety of the operation.

The scope of the present invention is not restricted to the preferred embodiments shown in the drawings and described in the specification but can be varied with the scope of the claims. As an example, if desired, it would be possible without any inventive activity to employ a securement device 5 having another cross section than circular, or the shape of a cap or ring. Additionally, the positioning of the initiation charge 2 and/or of the base charge 3 is not limited to the extremity of the detonator 1, nor is the nature of the insulating layer 4 limited to metals.

INDUSTRIAL APPLICABILITY

As illustrated in the examples above, but not restricted to solely these applications, the detonator device of the present invention is suitable for both civil and military applications, as such or as a component in a more complex detonating system.

The invention claimed is:

1. A detonator arrangement comprising:

a detonator having an initiation charge and a base charge, which initiation charge is arranged to initiate a detonation of said base charge, said detonator arrangement comprises a securement device which is movable in relation to the detonator, which securement device can be disposed in a first position arranged to prevent a transfer of the detonation of the initiation charge to the base charge, whereby the detonation of the base charge is avoided, and in a second position arranged to allow the transfer of the detonation of the initiation charge to the base charge, whereby the detonation of the base charge is obtained, wherein said securement device is arranged to be positioned at a distance from at least a part of said initiation charge in said first position and is arranged to surround at least said part of said initiation charge, in said second position.

2. The detonator arrangement according to claim 1, wherein the securement device in said second position is disposed to ensure a transition from deflagration to detonation of said initiation charge.

3. The detonator arrangement according to claim 1, wherein an insulating layer is disposed between said initiation charge and said base charge.

4. The detonator arrangement according to claim 3, wherein said insulating layer comprises a body.

5. The detonator arrangement according to claim 3, wherein said insulating layer comprises a body in the form of a metal containing disc.

6. The detonator arrangement according to claim 5, wherein the metal containing disc is an aluminum disc.

7. The detonator arrangement according to claim 1, wherein said securement device has a sleeve-shaped body.

8. The detonator arrangement according to claim 7, wherein a housing surrounding said initiation charge has a resistance to detonation which is lower than the resistance to detonation of said insulating layer, which in its turn is lower than the resistance to detonation of said securement device.

9. The detonator arrangement according to claim 1, wherein a housing surrounding said initiation charge is arranged to release a combustion energy of said initiation charge in another direction than towards said base charge when said securement device is in said first position.

10. The detonator arrangement according to claim 1, wherein said initiation charge comprises a secondary explosive, a pyrotechnical material or a combination thereof.

11. The detonator arrangement according to claim 1, wherein said securement device is arranged to be part of a fuzing system, or a blasting system.

12. The detonator arrangement according to claim 1, wherein said securement device has a cylinder-shaped body.

13. The detonator arrangement according to claim 1, wherein a housing surrounding said initiation charge is arranged to release a combustion energy of said initiation charge in another direction than towards said base charge when said securement device is in said first position by penetrating the side walls of the housing.

* * * * *